US007204705B2

(12) United States Patent
Negle et al.

(10) Patent No.: US 7,204,705 B2
(45) Date of Patent: Apr. 17, 2007

(54) HIGH-VOLTAGE CONNECTOR

(75) Inventors: Hans Negle, Nahe (DE); Bernd Wandler, Wedel (DE)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/541,408

(22) PCT Filed: Dec. 19, 2003

(86) PCT No.: PCT/IB03/06276

§ 371 (c)(1),
(2), (4) Date: Jul. 1, 2005

(87) PCT Pub. No.: WO2004/062044

PCT Pub. Date: Jul. 22, 2004

(65) Prior Publication Data

US 2006/0189173 A1 Aug. 24, 2006

(30) Foreign Application Priority Data

Jan. 7, 2003 (EP) ..... 03100010

(51) Int. Cl.
*H01R 13/53* (2006.01)

(52) U.S. Cl. ..... 439/181; 439/921

(58) Field of Classification Search ..... 439/99, 439/181, 183–187, 921
See application file for complete search history.

(56) References Cited

U.S. PATENT DOCUMENTS 4,296,986 A * 10/1981 Herrmann, Jr. ..... 439/322
5,857,862 A * 1/1999 Muench et al. ..... 439/181
6,416,338 B1 * 7/2002 Berlovan ..... 439/187

FOREIGN PATENT DOCUMENTS

DE 1 092 090 7/1959
GB 1 242 069 A * 8/1971

* cited by examiner

*Primary Examiner*—Khiem Nguyen

(57) ABSTRACT

A description is given of a high-voltage connector having a plug with a rubber cone (13) for insertion into a coupling socket (20). Such a connector is also referred to as a rubber cone plug system and serves in particular to connect X-ray radiators with high-voltage generators. The connector is noteworthy in particular in that the length of the rubber cone (13) is dimensioned such that, in the inserted state, there remains an expansion space (25) between an end face of the rubber cone (13) and a bottom of the coupling socket (20), into which expansion space (25) the rubber cone (13) can thermally expand. A particular advantage of this design lies in the fact that, by virtue of the thermal changes on account of highly fluctuating operating temperatures of the connected devices, the high-voltage strength is not impaired even after a large number of such temperature cycles.

19 Claims, 1 Drawing Sheet

HIGH-VOLTAGE CONNECTOR

Figure 1:
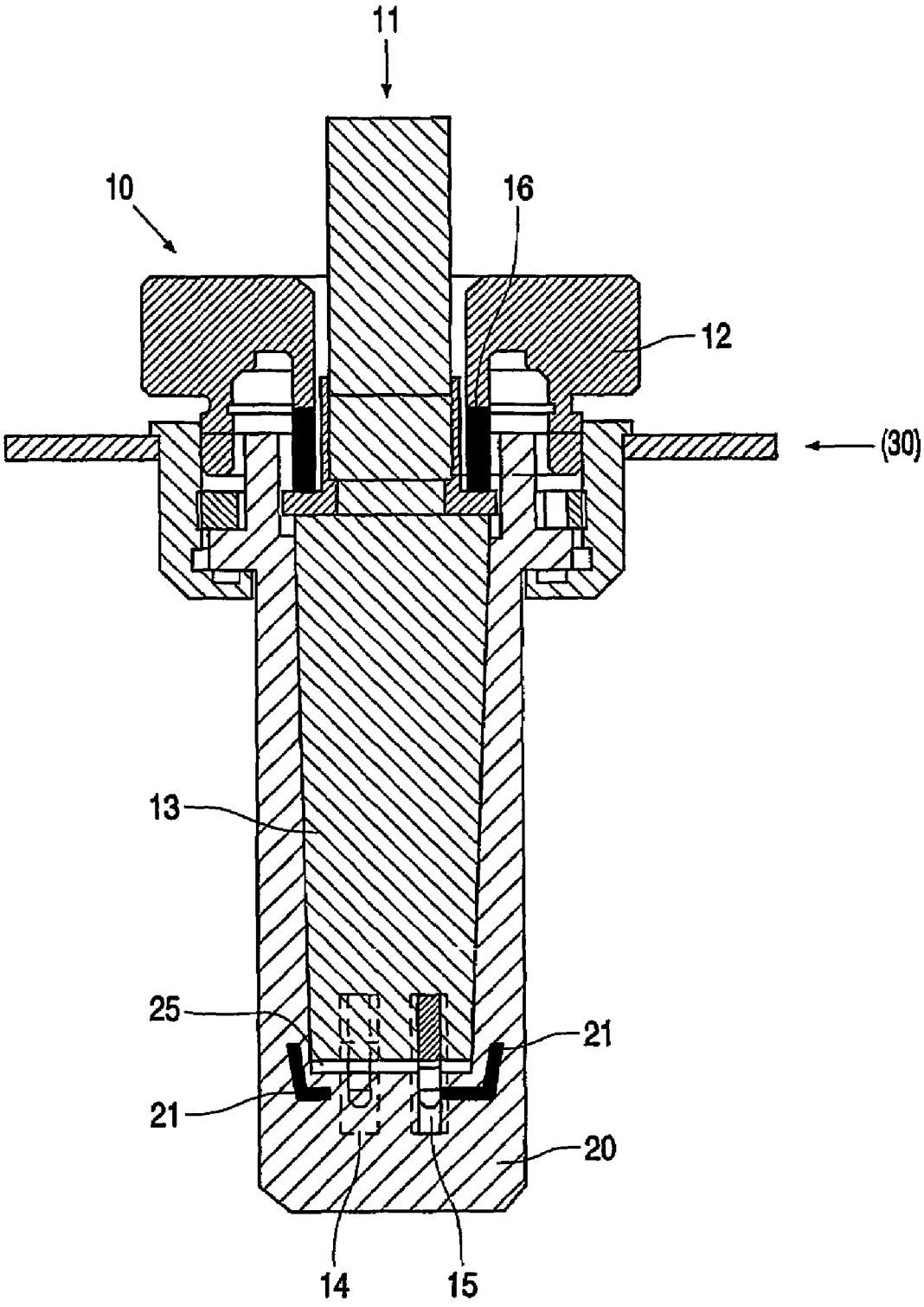

The invention relates to a high-voltage connector having a plug with a rubber cone for insertion into a coupling socket. Such a connector is also referred to as a rubber cone plug system and serves in particular to connect X-ray radiators to high-voltage generators.

A distinction is made between essentially three different high-voltage connectors or high-voltage plug systems. These are, first of all, what are known as O3 systems, which are relatively large and require a correspondingly large installation space in the X-ray radiator and the high-voltage generator. Furthermore, there are flat plug systems which have the largest diameter of the known systems. Finally, rubber cone plug systems are known which are of relatively simple construction and can be made with comparatively small dimensions.

However, a significant problem in the case of these rubber cone plug systems is that the temperature cycles and the associated expansions in particular of the rubber cone need to be controlled in order that the high-voltage strength of the plug system is not impaired thereby.

DE 1 092 090 discloses, for example, a rubber cone plug system in which a gap between a plug pushed over a cable end and a coupling socket on the high-voltage consumer is filled with vaseline at the bottom of the coupling socket in order to insulate the high-voltage potential from the ground potential. Since, during the heating-up of the high-voltage consumer, said gap does not thermally expand to as great an extent as the vaseline therein expands, an overpressure would be generated by means of which the substantially liquid vaseline is pressed outward through the seals of the plug system. After the system has cooled down, air bubbles would then form, which decrease the high-voltage strength. In order to avoid this, a means that responds to the overpressure (for example a hole covered with a membrane) is provided, so that the gap available for the vaseline is temporarily enlarged.

However, such a plug system is considered to be disadvantageous since said means make the system more expensive and it cannot be completely ruled out either that when there is occasional excessive heating, Vaseline will still escape and air bubbles will be left behind after cooling.

It is therefore an object of the invention to provide a high-voltage connector of the type mentioned above, the high-voltage strength of which is reliably maintained over a long period of time.

Furthermore, the invention is intended to provide a high-voltage connector of the type mentioned above in which occasional spark discharges in particular in the region of and along the high-voltage contacts or pins in the connector are also at least substantially avoided.

Finally, the invention is intended to provide a high-voltage connector of the type mentioned above which can be constructed relatively simply and manufactured in a cost-effective manner.

The object as claimed in claim 1 is achieved by a high-voltage connector having a plug with a rubber cone for insertion into a coupling socket, wherein the length of the rubber cone is dimensioned such that, in the inserted state, there remains an expansion space between an end face of the rubber cone and a bottom of the coupling socket, into which expansion space the rubber cone can expand thermally.

A particular advantage of this solution is that the high-voltage strength is not impaired even throughout a large number of temperature cycles which include considerable temperature fluctuations on account of changing operating temperatures of the connected devices.

A further advantage of this solution is that the high-voltage connector can be made in a relatively small constructional design.

The dependent claims contain advantageous further embodiments of the invention.

Claims 2 and 3 contain preferred media with which the expansion space is filled.

By means of the embodiment as claimed in claim 4, the high-voltage strength is further increased and also spark discharges at the high-voltage contacts are avoided, which spark discharges can lead to radio interference and impair the EMC (ElectroMagnetic Compatibility).

Finally, by means of the embodiment as claimed in claim 5, the situation is achieved that the plug rests in the coupling socket securely and with sufficient pressure even after a large number of temperature cycles.

The invention will be further described with reference to examples of embodiments shown in the drawing to which, however, the invention is not restricted.

FIG. 1 schematically shows a cross section through a high-voltage connector according to the invention.

The high-voltage connector essentially comprises a plug 10 (shown by dark hatching) and a coupling socket 20 (shown by light hatching). The end of a high-voltage cable 11 is connected to the plug 10, while the coupling socket 20 is incorporated in a conventional manner into a casing 30 of a high-voltage consumer such as, for example, an X-ray radiator.

After insertion into the coupling socket 20, the plug 10 is retained by a fastening device 12 such as, for example, a bayonet or screw coupling on the coupling socket 20.

An essential part of the plug 10 is the rubber cone 13, on the lower end of which in FIG. 1 contact pins 14, 15 for the high-voltage connection to the high-voltage consumer are arranged (the high-voltage lines connected to the contact pins 14, 15 in the coupling socket 20 are not shown).

As can also be seen in FIG. 1, there is an expansion space 25 between the free end of the rubber cone 13 and the bottom of the coupling socket 20. This expansion space 25 is at least deep enough to offer enough space for an axial thermal expansion of the rubber cone 13 upon heating to any realistic operating temperature by the connected components.

The expansion space 25 is in the simplest case filled with air. However, it may also contain another gas such as nitrogen, for example, or, where appropriate, may be under vacuum. Furthermore, the expansion space 25 may also be filled with a material that can be compressed by the thermally expanding rubber cone 13. Such a material is, for example, an appropriately soft rubber or silicone having gas cavities.

As can further be seen in FIG. 1, a potential well 21 is slid into the coupling socket 20 in the region of the expansion space 25, which potential well 21 has essentially the shape of a saucer in the bottom of which there are one or more openings for the contact pins 14, 15 and which surrounds the expansion space 25 with its rim. The potential well 21 is made of an electrically conductive material and is electrically connected to at least one of the high-voltage pins 14, 15.

The potential well 21 essentially acts as a Faraday cage which shields the expansion space 25. This prevents spark-over or breakdown along the contact pins 14, 15, which are generally relatively sharp-edged, which spark-over may cause radio interference in electrical devices arranged nearby and impair the EMC of the high-voltage connector.

Furthermore, this increases the high-voltage shock-resistance of the overall expansion space 25 and thus of the high-voltage connector as such, in particular even at any depth of the expansion space 25 which is dependent on the temperature of the rubber cone 13 at a given instant.

Finally, between a circular groove on the plug 10 and the fastening device 12, there is a compression spring 16, such as a spring washer for example, against which the rubber cone 13 can likewise thermally expand and which effects prestressing of the rubber cone 13 in the direction of the inserted position.

The invention claimed is:

1. A high-voltage connector having a plug (10) with a rubber cone (13) for insertion into a coupling socket (20), in which the length of the rubber cone (13) is dimensioned such that, in a fastened state, there remains an expansion space (25) between an end face of the rubber cone (13) and a bottom of the coupling socket (20), into which expansion space (25) the rubber cone (13) can expand thermally.

2. A high-voltage connector as claimed in claim 1, in which the expansion space (25) is filled with a medium which can be compressed by a thermal expansion of the rubber cone (13).

3. A high-voltage connector as claimed in claim 2, in which the medium is at least one of a gas or a silicone material having gas cavities.

4. A high-voltage connector as claimed in claim 1, in which a potential well (21) is arranged in the coupling socket (20), which potential well (21) is connected to at least one high-voltage contact pin (14, 15) of the connector and encloses the expansion space (25) at least to the extent that during the intended use no spark discharges can occur at the contact pin (14, 15).

5. A high-voltage connector as claimed in claim 1, having a compression spring (16) acting on the plug (10), by means of which compression spring (16) the latter is prestressed in the direction of the inserted position.

6. A high-voltage connector as claimed in claim 3, wherein the gas is nitrogen.

7. A high-voltage connector as claimed in claim 1, in which the expansion space (25) is filled with a vacuum.

8. A high-voltage connector as claimed in claim 4, wherein the potential well (21) has an opening and the contact pins (14, 15) are positioned through the opening.

9. A high-voltage connector comprising:

a plug (10) with a rubber cone (13) for insertion into a coupling socket (20), the rubber cone (13) having dimensions to provide for an expansion space (25) between the rubber cone (13) and the coupling socket (20) when the rubber cone (13) has been fastened into the coupling socket (20), wherein the expansion space (25) allows for thermal expansion of the rubber cone (13).

10. A high-voltage connector as claimed in claim 9, further comprising:

a potential well (21) in the coupling socket (20) and connected to at least one high-voltage contact pin (14, 15), the potential well (21) surrounding the expansion space (25) to prevent spark discharges at the contact pin (14, 15).

11. A high-voltage connector as claimed in claim 10, in which the expansion space (25) is filled with a medium which can be compressed by a thermal expansion of the rubber cone (13).

12. A high-voltage connector as claimed in claim 11, in which the medium is a gas.

13. A high-voltage connector as claimed in claim 12, wherein the gas is air.

14. A high-voltage connector as claimed in claim 12, wherein the gas is nitrogen.

15. A high-voltage connector as claimed in claim 11, in which the medium is a silicone material having gas cavities.

16. A high-voltage connector as claimed in claim 10, in which the expansion space (25) is filled with a vacuum.

17. A high-voltage connector as claimed in claim 10, further comprising a compression spring (16) acting on the plug (10).

18. A high-voltage connector as claimed in claim 17, wherein the compression spring (16) biases the plug (10) in a direction of an inserted position.

19. A high-voltage connector as claimed in claim 10, wherein the potential well (21) has an opening and the contact pins (14, 15) are positioned through the opening.

* * * * *